US011092909B2

(12) United States Patent
Iida

(10) Patent No.: US 11,092,909 B2
(45) Date of Patent: Aug. 17, 2021

(54) CHARGING DEVICE AND IMAGE FORMING APPARATUS

(71) Applicant: FUJIFILM Business Innovation Corp., Tokyo (JP)

(72) Inventor: Hirofumi Iida, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/793,403

(22) Filed: Feb. 18, 2020

(65) Prior Publication Data

US 2021/0080850 A1 Mar. 18, 2021

(30) Foreign Application Priority Data

Sep. 18, 2019 (JP) ..... JP2019-169515

(51) Int. Cl.
*G03G 15/02* (2006.01)

(52) U.S. Cl.
CPC ..... *G03G 15/0266* (2013.01)

(58) Field of Classification Search
CPC ..... G03G 15/0208; G03G 15/0216; G03G 15/0233; G03G 15/0266
See application file for complete search history.

(56) References Cited

U.S. PATENT DOCUMENTS 5,842,081 A * 11/1998 Kaname ..... G03G 15/0216 399/50
5,842,087 A * 11/1998 Matsushita ..... G03G 15/0216 399/174
7,835,655 B2 * 11/2010 Kobashi ..... G03G 15/0266 399/174
2003/0012584 A1 * 1/2003 Yamanoi ..... G03G 15/0216 399/174
2003/0185593 A1 * 10/2003 Suzuki ..... G03G 15/0216 399/175
2003/0228172 A1 * 12/2003 Nakamura ..... G03G 15/0266 399/174
2004/0005158 A1 * 1/2004 Oku bo ..... G03G 15/0266 399/50
2004/0018029 A1 * 1/2004 Nishihama ..... G03G 15/0233 399/174
2004/0136749 A1 * 7/2004 Kinoshita ..... G03G 15/0216 399/129
2005/0008396 A1 * 1/2005 Nakamura ..... G03G 15/0233 399/175
2006/0245774 A1 * 11/2006 Nakamura ..... G03G 15/5037 399/50
2007/0286633 A1 * 12/2007 Takuma ..... G03G 21/203 399/94

(Continued)

FOREIGN PATENT DOCUMENTS

JP 2007-33835 A 2/2007

*Primary Examiner* — David J Bolduc
(74) *Attorney, Agent, or Firm* — Sughrue Mion, PLLC

(57) ABSTRACT

A charging device includes: a first charging unit that contacts a unit to be charged to charge the unit to be charged to a first charging potential; and a second charging unit that contacts the unit to be charged on a side upstream of the first charging unit in a direction of movement of the unit to be charged to charge the unit to be charged to a second charging potential that is lower than the first charging potential.

9 Claims, 9 Drawing Sheets

(56) References Cited

U.S. PATENT DOCUMENTS

| | | | | |
|---|---|---|---|---|
| 2009/0041502 | A1* | 2/2009 | Komatsu | G03G 15/0216 399/175 |
| 2009/0123184 | A1* | 5/2009 | Kobashi | G03G 15/0216 399/175 |
| 2011/0150532 | A1* | 6/2011 | Shimura | G03G 15/1605 399/175 |
| 2012/0033984 | A1* | 2/2012 | Ikeda | G03G 15/0291 399/50 |
| 2012/0201553 | A1* | 8/2012 | Hano | G03G 15/0233 399/50 |
| 2012/0269534 | A1* | 10/2012 | Fuse | G03G 15/0216 399/89 |
| 2013/0223885 | A1* | 8/2013 | Iwasaki | G03G 15/0216 399/175 |
| 2013/0287443 | A1* | 10/2013 | Lam | G03G 15/0233 399/174 |
| 2014/0064790 | A1* | 3/2014 | Toyonori | G03G 15/0233 399/175 |
| 2017/0090326 | A1* | 3/2017 | Yamaguchi | G03G 13/025 |

* cited by examiner

CHARGING DEVICE AND IMAGE FORMING APPARATUS

CROSS-REFERENCE TO RELATED APPLICATIONS

This application is based on and claims priority under 35 USC 119 from Japanese Patent Application No. 2019-169515 filed Sep. 18, 2019.

BACKGROUND

(i) Technical Field

The present disclosure relates to a charging device and an image forming apparatus.

(ii) Related Art

There has hitherto been proposed a charging device that includes a plurality of charging members, for example (Japanese Unexamined Patent Application Publication No. 2007-33835).

Japanese Unexamined Patent Application Publication No. 2007-33835 provides a device that includes a first charging member that charges a body to be charged to a target potential, a second charging member that preliminarily charges the body to be charged with a polarity opposite to the target potential, and a control unit that controls a charging potential with the opposite polarity to which the body to be charged is charged by the second charging member such that a DC current that flows through the first charging member is a prescribed value or more when the body to be charged is charged by the first charging member.

SUMMARY

Aspects of non-limiting embodiments of the present disclosure relate to suppressing fluctuations in a charging potential for a body to be charged compared to the case where a second charging potential applied by a second charging unit that contacts a unit to be charged on the side upstream of a first charging unit in the direction of movement of the unit to be charged is higher than a first charging potential.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a charging device including: a first charging unit that contacts a unit to be charged to charge the unit to be charged to a first charging potential; and a second charging unit that contacts the unit to be charged on a side upstream of the first charging unit in a direction of movement of the unit to be charged to charge the unit to be charged to a second charging potential that is lower than the first charging potential.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the drawings.

First Exemplary Embodiment

Figure 1:
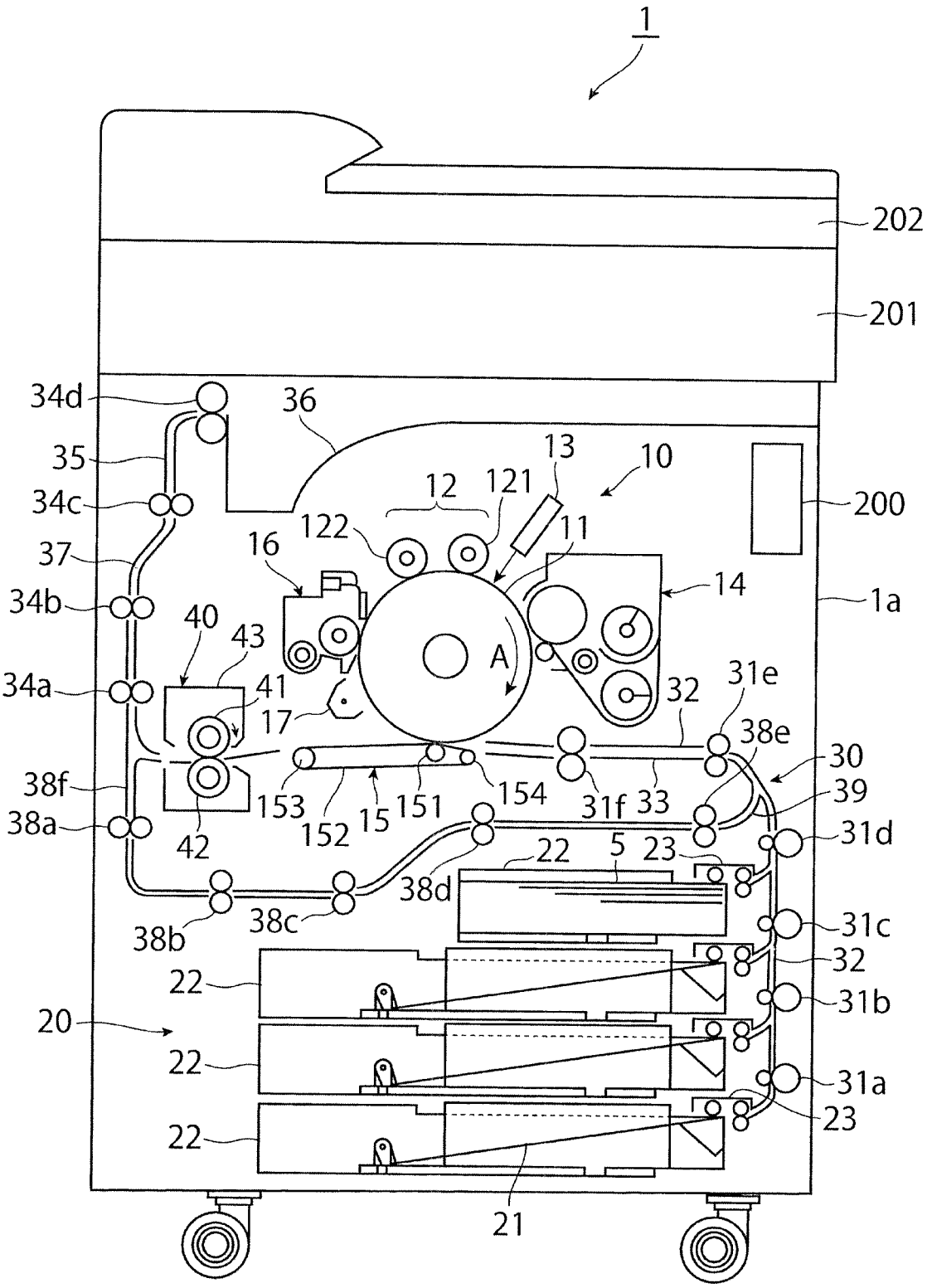
FIG. 1 illustrates a schematic configuration of an image forming apparatus including a charging device according to a first exemplary embodiment of the present disclosure.
Figure 2:
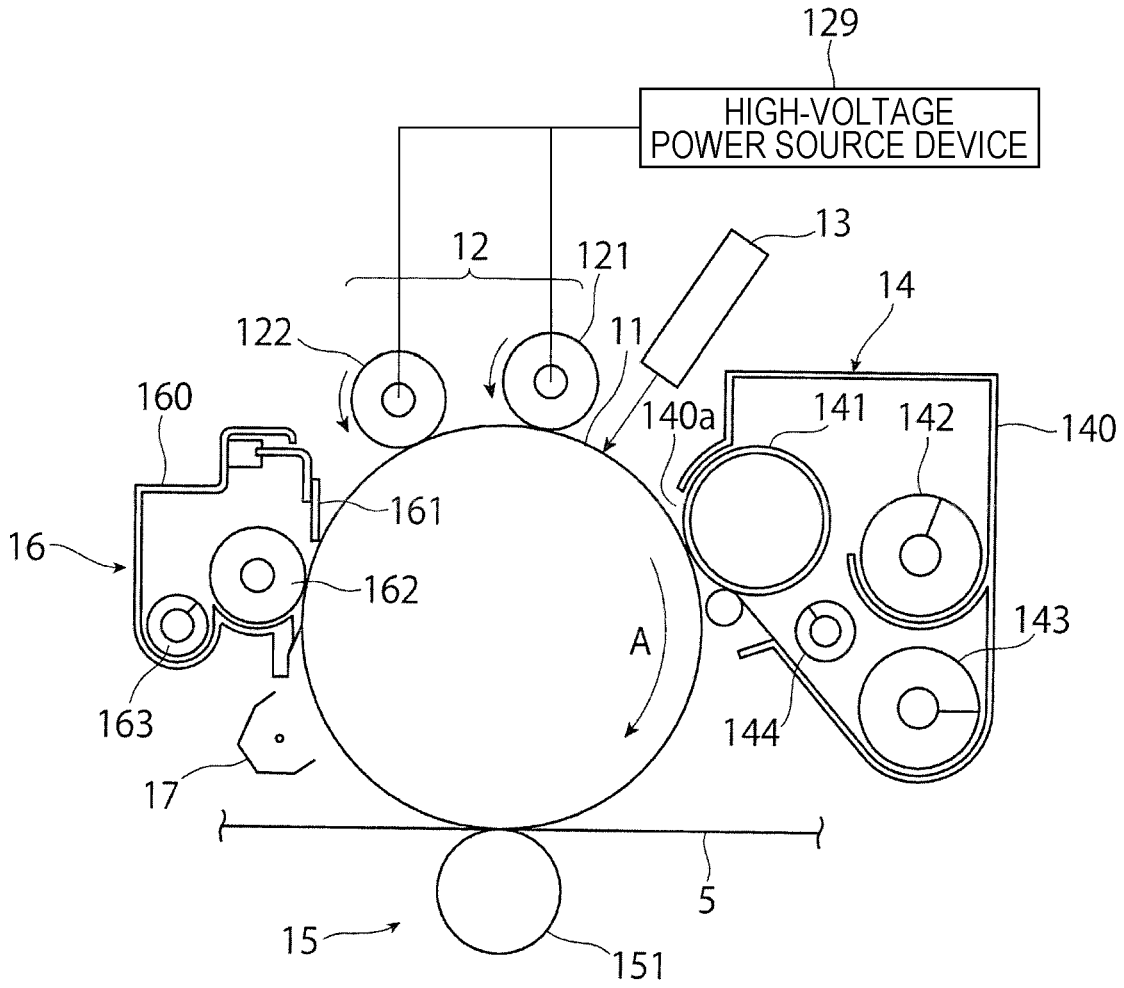
FIG. 2 illustrates a schematic configuration of an image preparing device of the image forming apparatus according to the first exemplary embodiment of the present disclosure.

FIGS. 1 and 2 illustrate an image forming apparatus including a charging device according to a first exemplary embodiment. FIG. 1 illustrates an overview of the entire image forming apparatus. FIG. 2 illustrates a portion (such as an image preparing device) of the image forming apparatus as enlarged.

<Overall Configuration of Image Forming Apparatus>

An image forming apparatus 1 according to the first exemplary embodiment is constituted as a monochrome printer, for example. As illustrated in FIG. 1, the image forming apparatus 1 includes an image preparing device 10, a paper feed device 20, a transport device 30, a fixing device 40, etc. The image preparing device 10 is an example of an image forming unit that forms a toner image to be developed using a toner that constitutes a developer. The paper feed device 20 stores and supplies recording paper 5 as an example of a recording medium to be supplied to a transfer position of the image preparing device 10. The transport device 30 transports the recording paper 5 supplied from the paper feed device 20 along a transport path. The fixing device 40 fixes the toner image on the recording paper 5 transferred by the image preparing device 10.

The image preparing device 10 includes a rotatable photosensitive drum 11 as an example of an image holding unit (unit to be charged). The following devices are disposed around the photosensitive drum 11. The devices include a charging device 12, an exposure device 13, a developing device 14, a transfer device 15, a static eliminating device 17, a drum cleaning device 16, etc. The charging device 12 according to the present exemplary embodiment charges a peripheral surface (image holding surface) of the photosensitive drum 11, on which an image may be formed, to a prescribed potential. The exposure device 13 radiates light based on information (signal) on an image to the charged peripheral surface of the photosensitive drum 11 to form an electrostatic latent image with a potential difference. The developing device 14 develops the electrostatic latent image using a toner of the developer for black color to form a toner image. The transfer device 15 transfers the toner image to the recording paper 5. The static eliminating device 17 eliminates static from the image holding surface of the photosensitive drum 11 after the transfer. The drum cleaning device 16 removes attached matter such as a toner remaining on and adhering to the image holding surface of the photosensitive drum 11 after the static elimination to clean the photosensitive drum 11.

The photosensitive drum 11 has an image holding surface formed by providing a photoconductive layer (photosensitive layer) made of a photosensitive material on the peripheral surface of a grounded cylindrical or columnar base material. The photosensitive drum 11 is supported so as to receive power from a drive device (not illustrated) to rotate in the direction indicated by the arrow A. In the first exemplary embodiment, the rotational speed (peripheral speed) of the photosensitive drum 11 is set to be relatively high at about 400 mm/sec.

The charging device 12 is constituted as a contact charging roller disposed in contact with the photosensitive drum 11. The charging device 12 includes a first charging roller 121 as an example of a first charging unit, and a second charging roller 122 as an example of a second charging unit disposed upstream of the first charging roller 121 along a rotational direction A of the photosensitive drum 11. A charging voltage is supplied to the charging device 12. In the case where the developing device 14 performs reversal development, a voltage or a current having the same polarity as the polarity for charging the toner supplied from the developing device 14 is supplied as the charging voltage. The charging device 12 will be discussed in detail later.

The exposure device 13 is constituted of a light emitting diode (LED) print head that radiates light according to image information to the photosensitive drum 11 using plural LEDs that serve as light emitting elements arranged along the axial direction of the photosensitive drum 11 to form an electrostatic latent image. In the exposure device 13, deflection scanning may be performed along the axial direction of the photosensitive drum 11 using laser light configured in accordance with the image information.

As illustrated in FIG. 2, the developing device 14 includes a housing 140, a developing roller 141, agitation/transport members 142 and 143, a layer thickness restricting member (not illustrated), a supply roller 144, etc. The housing 140 includes an opening portion and a storing chamber for the developer, and houses the other components. The developing roller 141 is an example of a developer holding unit that holds the developer 4 and transports the developer 4 to a development region facing the photosensitive drum 11. The agitation/transport members 142 and 143, which may be two screw augers, transport the developer 4 to cause the developer 4 to pass through the developing roller 141 while agitating the developer 4. The layer thickness restricting member restricts the amount (layer thickness) of the developer held by the developing roller 141. The supply roller 144 supplies the developer recovered from the outer peripheral surface of the developing roller 141 to the agitation/transport member 143. A development bias voltage supplied from a power source device (not illustrated) is applied between the developing roller 141 of the developing device 14 and the photosensitive drum 11. In addition, power from a drive device (not illustrated) is transmitted to the developing roller 141, the agitation/transport members 142 and 143, and the supply roller 144 to rotate the developing roller 141, the agitation/transport members 142 and 143, and the supply roller 144 in a prescribed direction. Further, a two-part developer containing a non-magnetic toner and a magnetic carrier is used as the developer.

As illustrated in FIG. 1, the transfer device 15 is a contact transfer device that includes a transfer roller 151 and a transfer belt 152. The transfer roller 151 rotates in contact with the periphery of the photosensitive drum 11 via the recording paper 5 during image formation, and is supplied with a transfer voltage. The transfer belt 152 transports the recording paper 5. The transfer belt 152 is tensely stretched between a driving roller 153 and a driven roller 154. A DC voltage with a polarity opposite to the polarity for charging the toner is supplied from a power source device (not illustrated) as the transfer voltage.

The static eliminating device 17 may be a corotron etc. that eliminates static by applying a charge with a polarity opposite to the charging polarity of the charging device 12 to the image holding surface of the photosensitive drum 11 after the transfer.

As illustrated in FIG. 2, the drum cleaning device 16 includes a body 160, a cleaning plate 161, a cleaning brush 162, a feeding member 163, etc. The body 160 has the shape of a partially open container. The cleaning plate 161 is disposed so as to contact the peripheral surface of the photosensitive drum 11, after the transfer, with a prescribed pressure to clean the photosensitive drum 11 by removing attached matter such as a residual toner. The cleaning brush 162 is also disposed so as to contact the peripheral surface of the photosensitive drum 11 with a prescribed pressure to clean the photosensitive drum 11 by removing attached matter such as a residual toner. The feeding member 163, which may be a screw auger, recovers attached matter, such as a toner, removed by the cleaning plate 161 and the cleaning brush 162 to feed the attached matter to a recovery container (not illustrated). A plate-like member (e.g. a blade) made of a material such as rubber is used as the cleaning plate 161.

As illustrated in FIG. 1, the fixing device 40 includes a heating roller 41, a pressurizing roller 42, etc. disposed inside a device housing 43 formed with an introduction port and an ejection port for the recording paper 5. The heating roller 41 is an example of a heating rotary member (fixing unit) that rotates in the direction indicated by the arrow and that is heated by a heating unit such that the surface temperature is kept at a predetermined temperature. The pressurizing roller 42 is an example of a pressurizing rotary member that contacts the heating roller 41 at a predetermined pressure substantially along the axial direction of the heating roller 41 to be rotated. In the fixing device 40, a contact portion at which the heating roller 41 and the pressurizing roller 42 contact each other serves as a fixation nip part at which a prescribed fixation process (heating and pressurization) is performed.

The paper feed device 20 is disposed at a lower portion of an apparatus body 1*a*. The paper feed device 20 is principally composed of one or more paper storing members 22 and a feeding device 23. The paper storing members 22 store sheets of the recording paper 5 of desired size, type, etc. as stacked on a loading plate 21. The feeding device 23 feeds the recording paper 5, one sheet at a time, from the paper storing members 22. The paper feed device 20 is removable from the apparatus body 1*a* of the image forming apparatus 1 by grasping and drawing a grip portion (not illustrated) provided to the paper storing members 22 with a hand.

Examples of the recording paper 5 include regular paper for use for electrophotographic copiers, printers, etc., thin paper such as tracing paper, and overhead projector (OHP) sheets. In order to further improve the smoothness of the surface of an image after the fixation, the surface of the recording paper 5 is preferably as smooth as possible. For example, coated paper prepared by coating the surface of regular paper with a resin or the like, so-called cardboard with a relatively large basis weight such as art paper for printing, etc. may also be suitably used.

As illustrated in FIG. 1, a paper feed/transport path 33 is provided between the paper feed device 20 and the transfer device 15. The paper feed/transport path 33 is composed of one or more pairs of paper transport rollers 31*a* to 31*f* and a transport guide 32. The paper transport rollers 31*a* to 31*f* transport the recording paper 5 fed from the paper feed device 20 to the transfer position. The paper feed/transport path 33 is provided to extend upward along the vertical direction in the apparatus body 1*a*, and shaped to be curved inward of the apparatus body 1*a* at the middle thereof. The pair of paper transport rollers 31*f* which are disposed at a position immediately before the transfer position in the paper feed/transport path 33 are constituted as rollers (resist rollers) that adjust the transport timing for the recording paper 5, for example. In addition, the recording paper 5 after the transfer is transported from the transfer device 15 to the fixing device 40 by the transfer belt 152 of the transfer device 15.

In addition, an ejection/transport path 37 is provided above the ejection port of the transfer device 40. The ejection/transport path 37 transports the recording paper 5 to a paper ejection section 36 via one or more pairs of transport rollers 34*a* to 34*d* and a transport guide 35 to be ejected. The paper ejection section 36 is provided on the upper end surface of the apparatus body 1*a*.

Further, a two-sided printing transport path 39 is provided below the ejection port of the fixing device 40. The two-sided printing transport path 39 transports the recording paper 5 to the paper feed/transport path 33 via one or more pairs of transport rollers 38*a* to 38*e* and a transport guide 38*f*.

The recording paper 5 ejected from the fixing device 40 is once transported to the ejection/transport path 37 by a switching gate (not illustrated), and thereafter transported to the two-sided printing transport path 39 with the front and back sides of the recording paper 5 reversed by rotating the pairs of transport rollers 34*a* and 34*b* in reverse.

In FIG. 1, reference numeral 200 denotes a control device that comprehensively controls operation of the image forming apparatus 1. The control device 200 includes a central processing unit (CPU), a read only memory (ROM), a random access memory (RAM), a bus that connects between the CPU, the ROM, etc., a communication interface, etc. (not illustrated). In addition, reference numerals 201 and 202 denote an image reading device and a document transport device, respectively, disposed on top of the apparatus body 1*a* of the image forming apparatus 1.

<Basic Operation of Image Forming Apparatus>

Basic image forming operation performed by the image forming apparatus 1 will be described below.

The image forming apparatus 1 is controlled by the control device 200. When instruction information on a request for monochrome image forming operation (printing) is received from an operation panel (not illustrated) mounted to the apparatus body 1*a* or a user interface, a printer driver, etc. (not illustrated), the image preparing device 10, the paper feed device 20, the transport device 30, the fixing device 40, etc. are started.

In the image preparing device 10, as illustrated in FIG. 1, first, the photosensitive drum 11 is rotated in the direction indicated by the arrow A, and the charging device 12 charges the surface of the photosensitive drum 11 with a prescribed polarity (in the first exemplary embodiment, negative polarity) and a prescribed potential. Subsequently, the exposure device 13 irradiates the surface of the photosensitive drum 11 after being charged with light emitted on the basis of the information on an image input to the image forming apparatus 1. Thus, an electrostatic latent image with a prescribed potential difference is formed on the surface of the photosensitive drum 11.

Subsequently, the developing device 14 develops the electrostatic latent image formed on the photosensitive drum 11 by supplying a toner for black color charged with a prescribed polarity (negative polarity) from the developing roller 141 for electrostatic adhesion. As a result of the development, the electrostatic latent image formed on the photosensitive drum 11 is rendered manifest as a toner image developed using a toner for black color.

Subsequently, when the toner image formed on the photosensitive drum 11 is transported to the transfer position, the transfer device 15 transfers the toner image to the recording paper 5.

In the image preparing device 10 which has finished the transfer, the static eliminating device 17 removes a residual charge on the surface of the photosensitive drum 11, and thereafter the drum cleaning device 16 removes, or scrapes off, attached matter to clean the surface of the photosensitive drum 11. This allows the image preparing device 10 to be ready for the next image preparing operation.

The paper feed device 20 feeds the prescribed recording paper 5 to the paper feed/transport path 33 in accordance with the image preparing operation. In the paper feed/transport path 33, the pair of paper transport rollers 31 as resist rollers feed the recording paper 5 to the transfer position in accordance with the transfer timing to supply the recording paper 5.

Subsequently, the recording paper 5 to which the toner image has been transferred is transported to the fixing device 40 by the transfer belt 152. In the fixing device 40, the recording paper 5 after the transfer is introduced to the fixation nip part between the heating roller 41 and the pressurizing roller 42, which are rotating, to pass through the fixation nip part. Thus, the recording paper 5 is subjected to a necessary fixation process (heating and pressurization) to fix an unfixed toner image to the recording paper 5. In the case of image forming operation in which an image is to be formed on only one surface of the recording paper 5, the recording paper 5 after the fixation is ejected to the paper ejection section 36 provided at the upper end portion of the apparatus body 1*a* by the pair of paper ejection rollers 34*d* along the ejection/transport path 37.

In the case where an image is to be formed on two surfaces of the recording paper 5, meanwhile, the recording paper 5, on one surface of which an image has been formed, is transported to the pairs of transport rollers 34*a* and 34*b* by the switching gate (not illustrated), and the recording paper 5 is once transported in the ejection direction by the pairs of transport rollers 34*a* and 34*b*. After that, the rotational direction of the pairs of transport rollers 34*a* and 34*b* is reversed with the pairs of transport rollers 34*a* and 34*b* holding the rear end of the recording paper 5 therebetween to reverse the front and back sides of the recording paper 5. After that, the recording paper 5 is transported to the transfer device 15 again via the two-sided printing transport path 39 by the pairs of transport rollers 38*a* to 38*e* to transfer a toner image to the back surface of the recording paper 5. The recording paper 5, to the back surface of which a toner image has been transferred, is transported to the fixing device 40 via the transfer belt 152 of the transfer device 15, subjected to a fixation process (heating and pressurization) performed by the fixing device 40, and ejected to the paper ejection section 36 by the pairs of transport rollers 34*a* to 34*d*.

The recording paper 5, on one surface or two surfaces of which a monochrome image has been formed, is output through the above operation.

<Configuration of Charging Device>

FIG. 2 illustrates the configuration of the charging device according to the first exemplary embodiment.

As illustrated in FIG. 2, the charging device 12 according to the first exemplary embodiment includes a first charging roller 121 and a second charging roller 122. The first charging roller 121 is disposed in contact with the photosensitive drum 11 as an example of a unit to be charged, and charges the photosensitive drum 11 to a first charging potential determined in accordance with an applied voltage and a discharge start voltage. The second charging roller 122 is disposed in contact with the photosensitive drum 11 on the side upstream of the first charging roller 121 along the rotational direction A of the photosensitive drum 11, and charges the photosensitive drum 11 to a second charging potential that is determined in accordance with an applied voltage and a discharge start voltage and that is lower than the first charging potential.

Figure 3A:
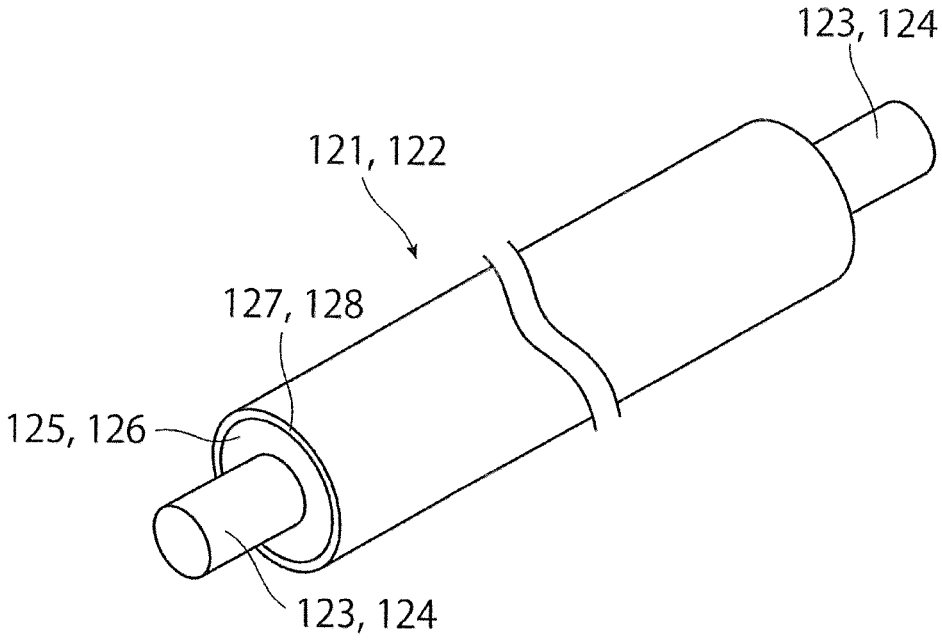
FIGS. 3A and 3B illustrate the configuration of the charging device according to the first exemplary embodiment of the present disclosure.
Figure 3B:
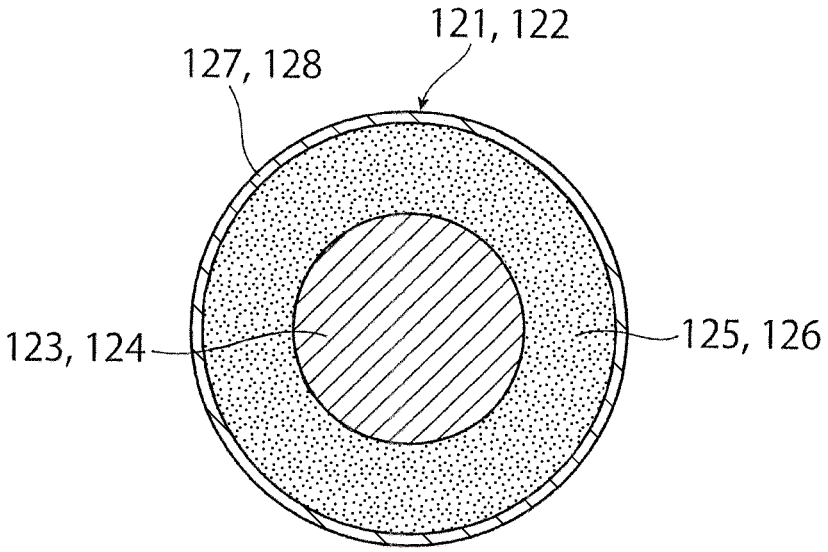

The first and second charging rollers 121 and 122 are basically constituted similarly to each other. As illustrated in FIGS. 3A and 3B, the first and second charging rollers 121 and 122 are each formed in a circular column shape, and have a core metal 123, 124, a semiconductive elastic body layer 125, 126, and a surface layer 127, 128. The core metal 123, 124 is in a circular column shape, and is made of metal such as stainless steel or iron. The outer periphery of the core metal 123, 124 is coated with the elastic body layer 125, 126 which has a prescribed thickness and which is conductive. The surface of the elastic body layer 125, 126 is coated with the surface layer 127, 128 which is thin. The core metal 123, 124 serves as a rotary shaft provided so as to project at both end portions along the axial direction of the first and second charging rollers 121 and 122. The first and second charging rollers 121 and 122 are pressed against the outer peripheral surface of the photosensitive drum 11 via the core metal 123, 124 by a biasing unit such as a coil spring (not illustrated), and is rotated in the following manner along with rotation of the photosensitive drum 11 with the elastic body layer 125, 126 and the surface layer 127, 128 elastically deformed so as to achieve a prescribed nip width.

As illustrated in FIG. 2, a high-voltage power source device 129 (an example of a voltage application unit) is connected to the core metals 123 and 124 of the first and second charging rollers 121 and 122 via a bearing member (not illustrated). The control device 200 controls the value of a high voltage applied to the charging rollers 121 and 122 by the high-voltage power source device 129 and the timing of application of the voltage. The high-voltage power source device 129 supplies a high DC voltage or a high DC current, determined in advance, with negative polarity which is the same as the polarity for charging the toner supplied from the developing device 14.

The elastic body layers 125 and 126 of the first and second charging rollers 121 and 122 are constituted from a porous foam that has internal cavities and surface asperities, for example. The elastic body layers 125 and 126 are constituted by dispersing a resistance adjusting agent, such as carbon black or an ionic conducting agent, in an expandable resin material, such as polyurethane, polyethylene, polyamide, olefin, melamine, or polypropylene, or an expandable rubber material, such as ethylene propylene terpolymer rubber (EPDM), acrylonitrile-butadiene copolymer rubber (NBR), styrene-butadiene rubber, chloroprene rubber, silicone rubber, nitrile rubber, or natural rubber, so as to have a prescribed resistance value. The volume resistivity of the elastic body layers 125 and 126 is set in the range of $10^4$ to $10^8$ Ω·cm, for example. The elastic body layers 125 and 126 may be solid rubber which is not expanded.

Meanwhile, the surface layers 127 and 128 of the first and second charging rollers 121 and 122 are provided by applying a paint in which a granular filler is dispersed to the outer peripheral surface of the elastic body layers 125 and 126, for example. Alternatively, the surface layers 127 and 128 of the charging rollers 121 and 122 may be constituted as a tube obtained by dispersing a conductive material in polytetrafluoroethylene (PTFE) or a perfluoroalkoxy alkane (PFA) and provided to cover the outer peripheral surface of the elastic body layers 125 and 126, for example.

The first and second charging rollers 121 and 122 may have only the elastic body layer 125, 126 and not the surface layer 127, 128.

In the charging device 12 according to the first exemplary embodiment, the charging potential (second charging potential) for charging the photosensitive drum 11 applied by the second charging roller 122, which is determined in accordance with the applied voltage and the discharge start voltage, is lower than the charging potential (first charging potential) for charging the photosensitive drum 11 applied by the first charging roller 121.

In other words, in the charging device 12 according to the first exemplary embodiment, the charging potential, which is determined in accordance with the applied voltage and the discharge start voltage, for charging the photosensitive drum 11 applied by the first charging roller 121, which is positioned on the downstream side along the rotational direction of the photosensitive drum 11, is higher than the charging potential for charging the photosensitive drum 11 applied by the second charging roller 121, which is positioned on the upstream side along the rotational direction of the photosensitive drum 11.

Figure 4:
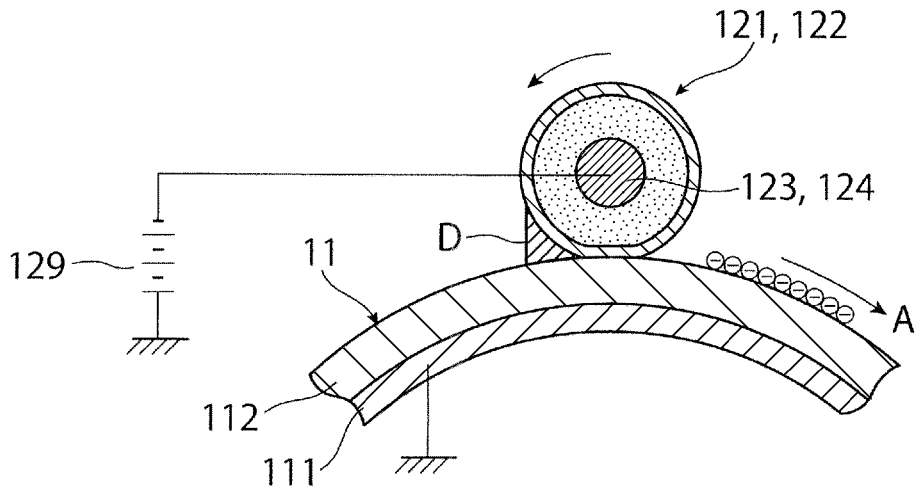
FIG. 4 is a sectional view illustrating the charging state of the charging device.

As illustrated in FIG. 4, when the first and second charging rollers 121 and 122 are pressed against the outer peripheral surface of the photosensitive drum 11 via the core metal 123, 124 by a biasing unit such as a coil spring (not illustrated), the elastic body layer 125, 126 and the surface layer 127, 128 are elastically deformed so as to achieve a prescribed nip width. The first and second charging rollers 121 and 122 apply a high DC voltage with negative polarity, determined in advance, to the core metal 123, 124 using the high-voltage power source device 129 to cause narrow gap discharge in a discharge region D formed between the first and second charging rollers 121 and 122 and the outer peripheral surface of the photosensitive drum 11, and charge the outer peripheral surface of the photosensitive drum 11 to a prescribed charging potential with negative polarity using charged particles generated in the narrow gap discharge. In FIG. 4, reference numeral 111 denotes a conductive substrate of the photosensitive drum 11, and reference numeral 112 denotes a photosensitive layer of the photosensitive drum 11. The conductive substrate 111 of the photosensitive drum 11 is grounded.

The high DC voltage applied to the core metals 123, 122 of the first and second charging rollers 121 and 122 and the charging potential for the outer peripheral surface of the photosensitive drum 11 have the following relationship.

The charging potentials for the photosensitive drum 11 applied by the first and second charging rollers 121 and 122 are determined in accordance with the applied voltage and the discharge start voltage. It is known that the discharge start voltage is determined on the basis of the Paschen's law. The charging potential for the photosensitive drum 11 applied by the first charging roller 121 is defined as Vh1. The charging potential for the photosensitive drum 11 applied by the second charging roller 122 is defined as Vh2. The voltage applied by the first charging roller 121 is defined as Vdc1. The voltage applied by the second charging roller 122 is defined as Vdc2. The discharge start voltage for the first charging roller 121 is defined as Vα1. The discharge start voltage for the second charging roller 122 is defined as Va2.

Figure 5:
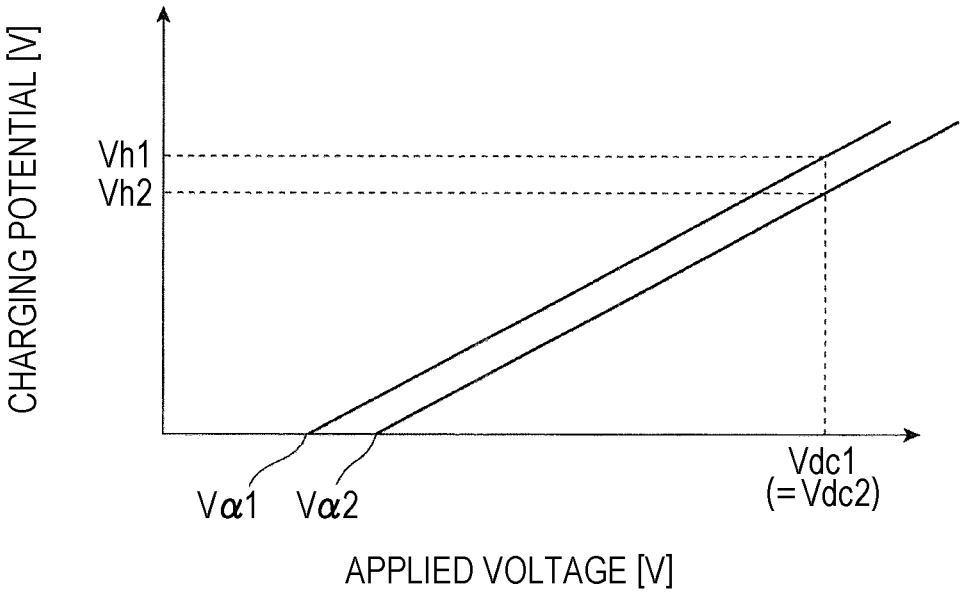
FIG. 5 is a graph illustrating the relationship between an applied voltage applied by charging rollers and a charging potential for a photosensitive drum.

Then, as illustrated in FIG. 5, the first and second charging potentials Vh1 and Vh2 for the photosensitive drum 11 applied by the first and second charging rollers 121 and 122, respectively, have a value obtained by subtracting the discharge start voltage Vα1, Va2 from the applied voltage Vdc1, Vdc2, and may be represented by the following formulas. The gradient of the lines is 1.

$$Vh1=Vdc1-V\alpha 1$$

$$Vh2=Vdc2-V\alpha 2$$

In the first exemplary embodiment, the volume resistivity of the elastic body layer 126 of the second charging roller 122 is set to be higher than the volume resistivity of the elastic body layer 125 of the first charging roller 121. That is, the amount of the resistance adjusting agent, such as carbon black or an ionic conducting agent, dispersed in the elastic body layer 126 of the second charging roller 122 is set to be smaller than that for the elastic body layer 125 of the first charging roller 121, and the volume resistivity of the elastic body layer 126 of the second charging roller 122 is higher than that of the elastic body layer 125 of the first charging roller 121. Therefore, the discharge start voltage Vα2 for the second charging roller 122, at which discharge is started and the second charging potential Vh2 for the photosensitive drum 11 starts rising, is higher (Vα2>Vα1) than the discharge start voltage Vα1 for the first charging roller 121 even in the case where a voltage Vdc2 (=Vdc1) that is equal to a voltage applied to the first charging roller 121 is applied to the second charging roller 122.

As a result, in the charging device 12 according to the first exemplary embodiment, when an equal voltage (Vdc1=Vdc2) is applied from the identical high-voltage power source device 129 to the first and second charging rollers 121 and 122, the second charging potential Vh2 for the photosensitive drum 11 applied by the second charging roller 122, which is determined in accordance with the applied voltage and the discharge start voltage, is lower than the first charging potential Vh1 applied by the first charging roller 122 (Vh1>Vh2). That is, the second charging potential Vh2 applied by the second charging roller 122, which is determined in accordance with the applied voltage and the discharge start voltage, is set to be lower than the first charging potential Vh1 which is a target charging potential Vβ for the photosensitive drum 11 applied by the charging device 12.

<Operation of Charging Device>

In the image forming apparatus including the charging device according to the first exemplary embodiment, as illustrated in FIG. 2, the outer peripheral surface of the photosensitive drum 11 is charged to a charging potential, determined in advance, by the charging device 12 when image forming operation is started.

In the charging device 12, as illustrated in FIG. 2, first, the outer peripheral surface of the photosensitive drum 11 is charged by the second charging roller 122. At this time, the applied voltage Vdc2 is applied to the second charging roller 122 by the high-voltage power source device 129. As illustrated in FIG. 5, the second charging roller 122 charges the outer peripheral surface of the photosensitive drum 11 to the second charging potential Vh2 which is determined in accordance with the applied voltage Vdc2 and the discharge start voltage Vα2.

After that, in the charging device 12, the outer peripheral surface of the photosensitive drum 11 is charged by the first charging roller 121. At this time, the applied voltage Vdc1, which is equal to the voltage applied to the second charging roller 122, is applied to the first charging roller 121 by the high-voltage power source device 129. As illustrated in FIG. 5, the first charging roller 121 charges the outer peripheral surface of the photosensitive drum 11 to the first charging potential Vh1 which is determined in accordance with the applied voltage Vdc1 and the discharge start voltage Vα1.

Figure 6:
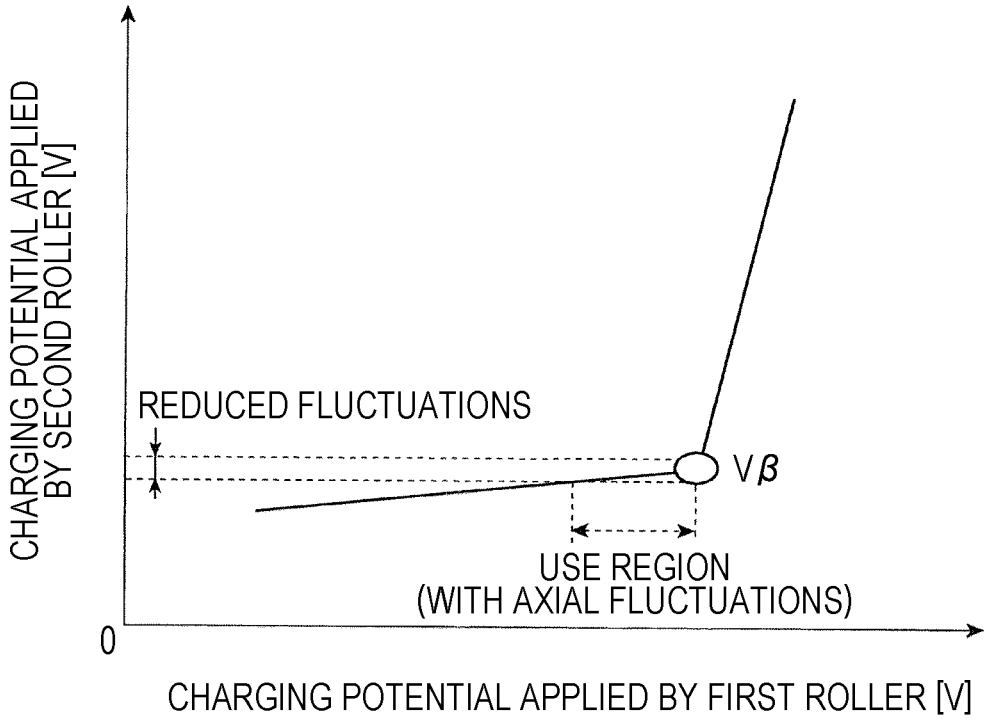
FIG. 6 is a graph illustrating the relationship between a charging potential applied by a second charging roller and a charging potential applied by a first charging roller.

Therefore, in the charging device 12 according to the first exemplary embodiment described above, as illustrated in FIG. 6, the second charging potential Vh2, which is the charging potential applied by the second charging roller 122 which is positioned on the side upstream along the rotational direction of the photosensitive drum 11, is set to be lower than the target charging potential Vβ for the photosensitive drum 11 applied by the charging device 12.

Thus, in the charging device 12 according to the first exemplary embodiment, the photosensitive drum 11 is charged to the first charging potential Vh1 by causing narrow gap discharge between the first charging roller 121 and the surface of the photosensitive drum 11, by charging the surface of the photosensitive drum 11 to the second charging potential Vh2 using the second charging roller 122 which is positioned on the upstream side along the rotational direction of the photosensitive drum 11 and thereafter charging the surface of the photosensitive drum 11 to the first charging potential Vh1, which is equal to the target charging potential Vβ, using the first charging roller 121 which is positioned on the downstream side along the rotational direction of the photosensitive drum 11.

In that event, the surface potential of the photosensitive drum 11 is the second charging potential Vh2 which is lower than the target charging potential Vβ.

The charging device 12 includes a plurality of charging units which are the first and second charging rollers 121 and 122.

Comparative Example

The inventor performs a comparative experiment, as a comparative example, in which identical charging rollers with an equal applied voltage and an equal discharge start voltage are used as the first and second charging rollers 121 and 122 and the surface of the photosensitive drum 11 is charged to the target charging potential Vβ by the first and second charging rollers 121 and 122. At this time, three types of charging rollers I to III of the same configuration and from different batches are used as the first charging roller 121.

Figure 7:
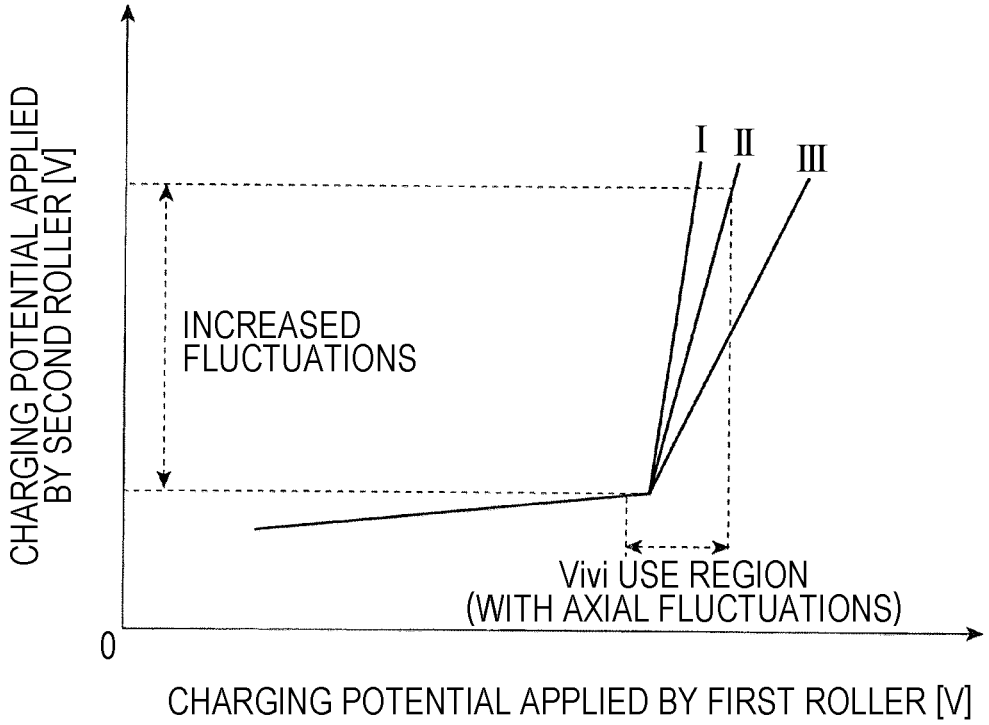
FIG. 7 is a graph illustrating the relationship between a charging potential applied by a second charging roller and a charging potential applied by a first charging roller in a comparative example.

FIG. 7 is a graph illustrating the results of the comparative example described above. In the graph, the horizontal axis represents the charging potential for the photosensitive drum 11 applied by the second charging roller 122, and the vertical axis represents the charging potential for the photosensitive drum 11 applied by the first charging roller 121.

It is seen that the charging potential for the photosensitive drum 11 applied by the first charging roller 121 is fluctuated significantly in accordance with characteristics I to III (batch differences) of the first charging roller 121, as is clear from FIG. 7, in the case where identical charging rollers with an equal applied voltage and an equal discharge start voltage are used as the first and second charging rollers 121 and 122 and the surface of the photosensitive drum 11 is charged to the target charging potential by the first and second charging rollers 121 and 122.

Figure 8:
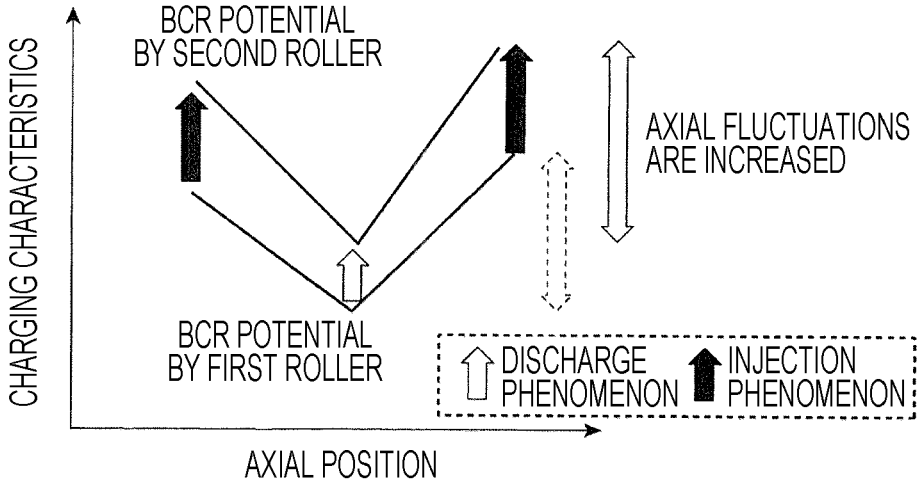
FIG. 8 is a graph illustrating the relationship between the axial position and the charging characteristics of the charging rollers according to the comparative example.

This is considered to be because, according to the consideration by the inventor, as illustrated in FIG. 8, a charge injection phenomenon occurs at end portions along the axial direction of the first charging roller 121, which increases fluctuations, along the axial direction, in the charging potential previously applied by the second charging roller 122, if identical charging rollers with an equal applied voltage and an equal discharge start voltage are used as the first and second charging rollers 121 and 122 and the surface of the photosensitive drum 11 is charged to the target charging potential by the first and second charging rollers 121 and 122.

For further description, it is considered that, in the case where identical charging rollers with an equal applied voltage and an equal discharge start voltage are used as the first and second charging rollers 121 and 122 and the surface of the photosensitive drum 11 is charged to the target charging potential by the first and second charging rollers 121 and 121, as illustrated in FIG. 8, a discharge phenomenon occurs at the middle portion of the first charging roller 121 to raise the charging potential for the photosensitive drum 11, while the charging potential for the photosensitive drum 11 has already been raised to a high potential with negative polarity as the target potential by the second charging roller 122 and therefore a charge injection phenomenon by the first charging roller 121 is induced on the side of both end portions along the axial direction of the first charging roller 121, at which the nip pressure tends to be raised compared to the middle portion.

Second Exemplary Embodiment

Figure 9:
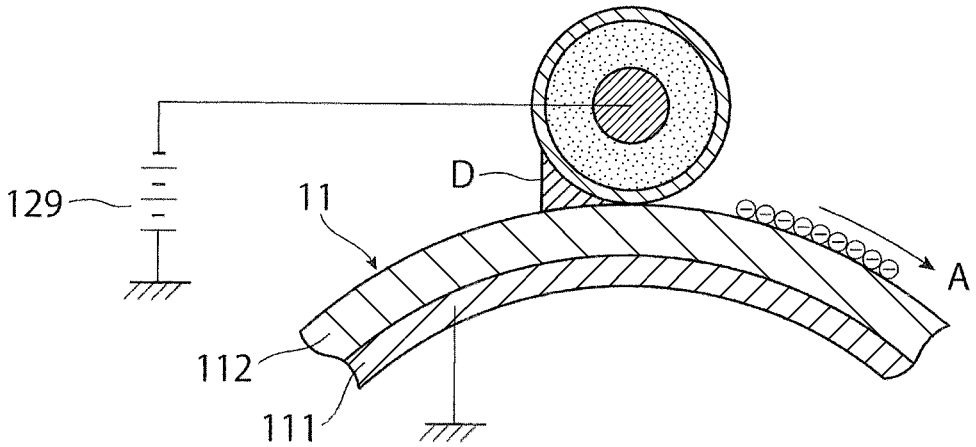
FIG. 9 is a sectional view illustrating the configuration of a charging device according to a second exemplary embodiment of the present disclosure.

FIG. 9 illustrates a charging device apparatus according to a second exemplary embodiment. In the charging device 12 according to the second exemplary embodiment, the contact load with which the second charging unit contacts the unit to be charged is set to be lower than that for the first charging unit.

That is, in the charging device 12 according to the second exemplary embodiment, as illustrated in FIG. 9, the contact load with which the second charging roller 122 contacts the photosensitive drum 11 is set to be lower than that for the first charging roller 121. Specifically, the spring constant of a biasing unit such as a coil spring (not illustrated) that presses the second charging roller 122 against the outer peripheral surface of the photosensitive drum 11 is set to be lower, or the amount of deformation of a biasing unit such as a coil spring (not illustrated) is determined to be smaller.

The contact load with which the second charging roller 122 contacts the photosensitive drum 11 being set to be lower in this manner corresponds to the interelectrode distance between the second charging roller 122 and the photosensitive drum 11 being increased, which makes the discharge start voltage Vα2 higher than that for the first charging roller 121 as is understood on the basis of the Paschen's law as in the case illustrated in FIG. 5.

Therefore, the charging potential for the photosensitive drum 11 applied by the second charging roller 122, which is determined in accordance with the applied voltage and the discharge start voltage, is determined to be lower than that applied by the first charging roller 121.

In the charging device 12 according to the second exemplary embodiment, identical members may be used as the first and second charging rollers 121 and 122.

The configuration and the operation are otherwise similar to those of the exemplary embodiment described earlier. Thus, such similarities are not described.

Third Exemplary Embodiment

Figure 10:
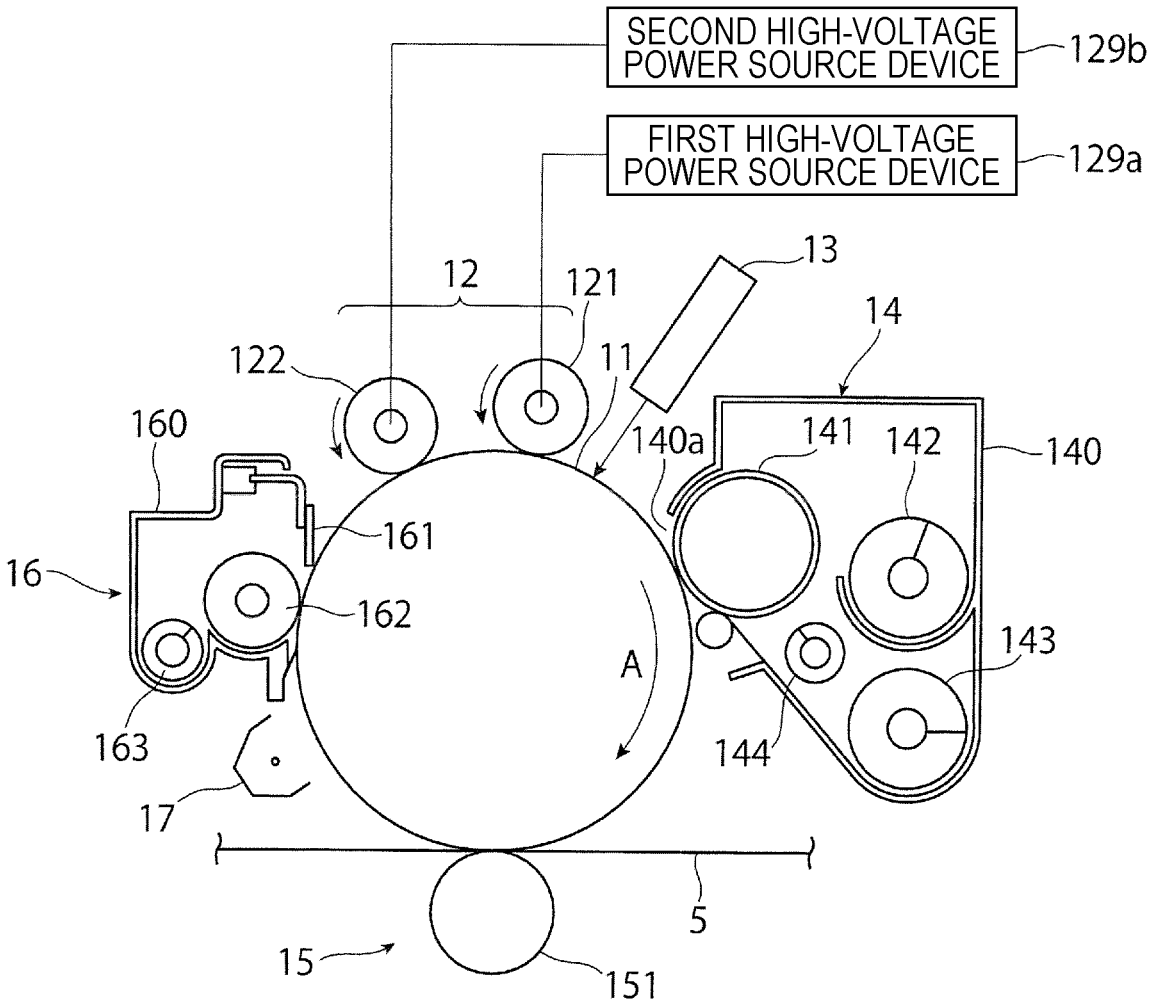
FIG. 10 illustrates the configuration of a portion of an image forming apparatus including a charging device according to a third exemplary embodiment of the present disclosure.

FIG. 10 illustrates a charging device apparatus according to a third exemplary embodiment. In the charging device 12 according to the third exemplary embodiment, the first and second charging rollers 121 and 122 include individual voltage application units.

In the third exemplary embodiment, in addition, the applied voltage applied by a second voltage application unit that applies a voltage to the second charging roller 122 is set to be lower than the applied voltage applied by a first voltage application unit that applies a voltage to the first charging roller. In the third exemplary embodiment, identical charging rollers are used as the first and second charging rollers 121 and 122.

That is, as illustrated in FIG. 10, the charging device 12 according to the third exemplary embodiment includes a first high-voltage power source device 129*a* and a second high-voltage power source device 129*b*. The first high-voltage power source device 129*a* serves as the first voltage application unit which applies a voltage to the first charging roller 121. The second high-voltage power source device 129*b* serves as the second voltage application unit which applies a voltage to the second charging roller 122. The applied voltage applied by the second high-voltage power source device 129*b* is set to be lower than that applied by the first high-voltage power source device 129*a* (Vdc1>Vdc2).

In the charging device 12 according to the third exemplary embodiment, the respective applied voltages applied by the first and second high-voltage power source devices 129*a* and 129*b* are set so as to meet the relationship Vdc1>Vdc2 in:

$$Vh1=Vdc1-V\alpha 1$$

$$Vh2=Vdc2-V\alpha 2$$

Figure 11:
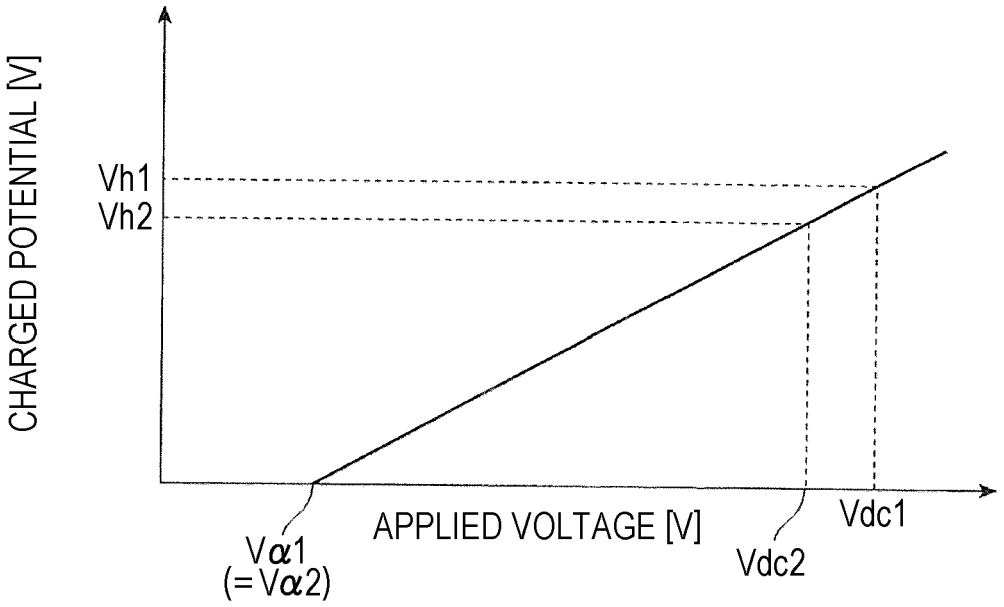
FIG. 11 is a graph illustrating the relationship between an applied voltage applied by charging rollers and a charging potential for a photosensitive drum.

Therefore, as illustrated in FIG. 11, in the charging device 12 according to the third exemplary embodiment, the charging potential Vh2 for the photosensitive drum 11 applied by the second charging roller 122 is lower than the charging potential Vh1 for the photosensitive drum 11 applied by the first charging roller 121.

In the charging device 12 according to the third exemplary embodiment, identical charging rollers may be used as the first and second charging rollers 121 and 122.

Figure 12:
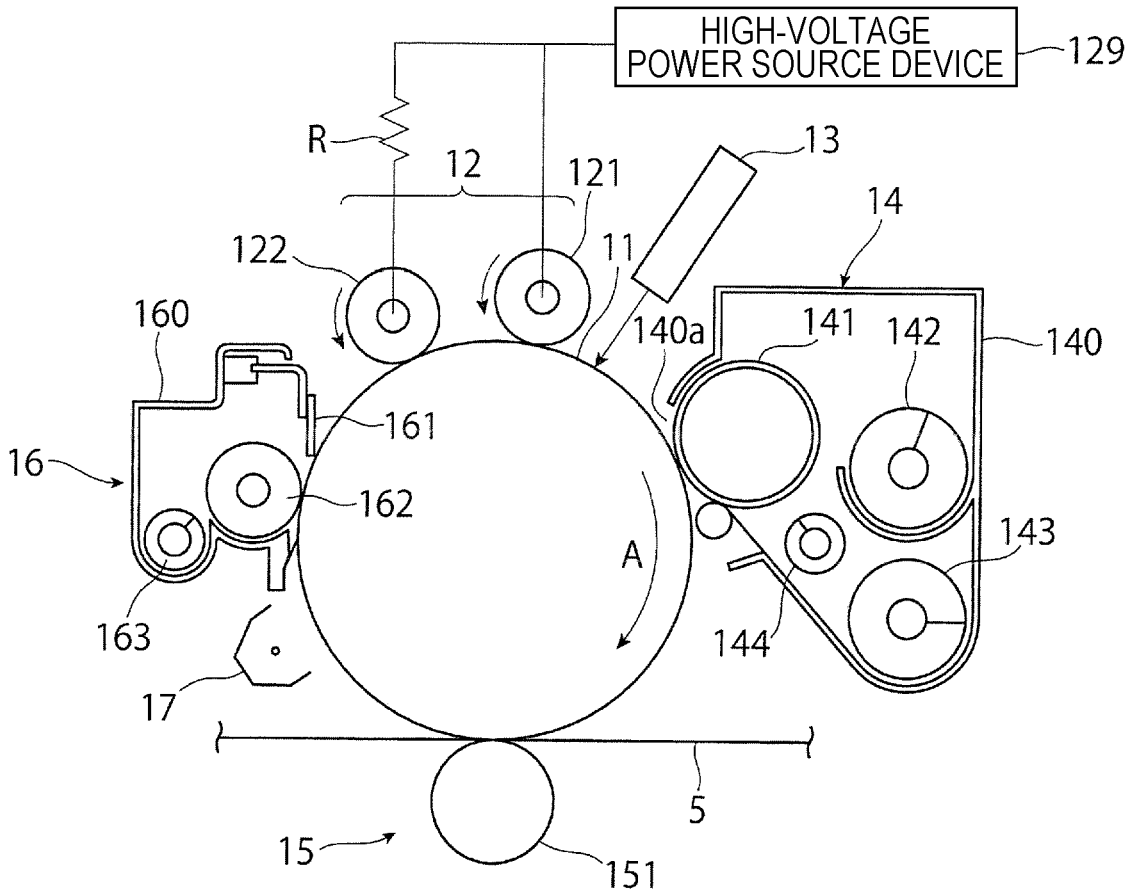
FIG. 12 illustrates the configuration of a modification of the charging device according to the third exemplary embodiment of the present disclosure.

In the third exemplary embodiment described above, the first and second high-voltage power source devices 129*a* and 129*b* are provided individually. However, as illustrated in FIG. 12, a common high-voltage power source device 129 may be substituted for the first and second high-voltage power source devices 129*a* and 129*b*, and a high voltage may be applied from the common high-voltage power source device 129 to the second charging roller 122 via a resistor R.

With such a configuration, the applied voltage to be applied to the second charging roller 122 may be set to be lower than that to be applied to the first charging roller 121 using the common high-voltage power source device 129.

The configuration and the operation are otherwise similar to those of the exemplary embodiment described earlier. Thus, such similarities are not described.

In the exemplary embodiments described above, a monochrome image forming apparatus is described as the image forming apparatus. It is a matter of course, however, that the present disclosure is also applicable to a full-color image forming apparatus that includes image preparing devices 10 (Y, M, C, K) for yellow (Y), magenta (M), cyan (C), and black (K).

In the exemplary embodiments described above, two charging members, namely the first and second charging rollers, are provided. However, three or more charging members may be provided. In this case, the charging potential for the unit to be charged applied by a charging unit disposed on the upstream side along the direction of movement of the unit to be charged is set to be lower than that applied by a charging unit disposed on the downstream side.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A charging device comprising:

a first charging unit configured to contact a unit to be charged to charge the unit to be charged to a first charging potential, wherein the first charging unit is configured to form a first nip between the first charging unit and the unit to be charged; and a second charging unit configured to contact the unit to be charged on a side upstream of the first charging unit in a direction of movement of the unit to be charged to charge the unit to be charged to a second charging potential that is lower than a charging potential that is determined by the first charging potential and the second charging potential, wherein the second charging unit is configured to form a second nip between the second charging unit and the unit to be charged, wherein a nip pressure at end portions of the first charging unit along an axial direction of the first charging unit is higher than a nip pressure at a center portion of the first charging unit in the axial direction of the first charging unit, and wherein a nip pressure at end portions of the second charging unit along an axial direction of the second charging unit is higher than a nip pressure at a center portion of the second charging unit in the axial direction of the second charging unit.

2. The charging device according to claim 1, further comprising:

a common voltage application unit configured to apply a voltage to the first charging unit and the second charging unit.

3. The charging device according to claim 2, wherein the second charging unit is formed to have a resistance that is higher than a resistance of the first charging unit.

4. The charging device according to claim 2, wherein a contact load with which the second charging unit contacts the unit to be charged is lower than a contact load with which the first charging unit contacts the unit to be charged.

5. The charging device according to claim 1, further comprising:

a first voltage application unit and a second voltage application unit, respectively for the first charging unit and the second charging unit, configured to individually apply a voltage to the first charging unit and the second charging unit.

6. The charging device according to claim 5, wherein the voltage applied to the second charging unit by the second voltage application unit is lower than the voltage applied to the first charging unit by the first voltage application unit.

7. An image forming apparatus comprising:

an image holding unit configured to hold an image; and a charging unit configured to charge the image holding unit, wherein the charging unit is the charging device according to claim 1.

8. A charging device comprising:

a first charging means for contacting a unit to be charged to charge the unit to be charged to a first charging potential, wherein the first charging means is for forming a first nip between the first charging means and the unit to be charged; and a second charging means for contacting the unit to be charged on a side upstream of the first charging means in a direction of movement of the unit to be charged to charge the unit to be charged to a second charging potential that is lower than a charging potential that is determined by the first charging potential and the second charging potential, wherein the second charging means is for forming a second nip between the second charging means and the unit to be charged, wherein a nip pressure at end portions of the first charging means along an axial direction of the first charging means is higher than a nip pressure at a center portion of the first charging means in the axial direction of the first charging means, and wherein a nip pressure at end portions of the second charging means along an axial direction of the second charging means is higher than a nip pressure at a center portion of the second charging means in the axial direction of the second charging means.

9. A charging device comprising:

a first charging roller configured to contact a photosensitive drum to charge the photosensitive drum to a first charging potential, wherein the first charging roller is configured to form a first nip between the first charging roller and the photosensitive drum; and a second charging roller configured to contact the photosensitive drum on a side upstream of the first charging roller in a direction of movement of the photosensitive drum to charge the photosensitive drum to a second charging potential that is lower than a charging potential that is determined by the first charging potential and the second charging potential, wherein the second charging roller is configured to form a second nip between the second charging roller and the photosensitive drum, wherein a nip pressure at end portions of the first charging roller along an axial direction of the first charging roller is higher than a nip pressure at a center portion of the first charging roller in the axial direction of the first charging roller, and wherein a nip pressure at end portions of the second charging roller along an axial direction of the second charging roller is higher than a nip pressure at a center portion of the second charging roller in the axial direction of the second charging roller.

* * * * *